United States Patent [19]

Eberle

[11] Patent Number: 4,607,793

[45] Date of Patent: Aug. 26, 1986

[54] SHOWER HEAD WHICH UNIFORMLY DISPENSES LIQUID ADDITIVES

[76] Inventor: Robert A. Eberle, 414 W. Burnett St., Beaver Dam, Wis. 53916

[21] Appl. No.: 598,362

[22] Filed: Apr. 9, 1984

[51] Int. Cl.[4] ..... B05B 7/30

[52] U.S. Cl. ..... 239/318; 239/434

[58] Field of Search ..... 239/310, 318, 304, 340, 239/425.5, 138, 434

[56] References Cited

U.S. PATENT DOCUMENTS

| | | | |
|---|---|---|---|
| 1,757,140 | 6/1930 | Pulkinghorn . | |
| 2,101,922 | 12/1937 | Stoesling | 239/434 X |
| 2,462,752 | 2/1949 | Kotches et al. | 239/318 X |
| 2,609,232 | 9/1952 | Taulman | 299/84 |
| 3,282,227 | 11/1966 | Nielsen | 239/318 X |
| 3,285,521 | 11/1966 | Coakley | 239/318 |
| 3,342,419 | 9/1967 | Weese | 239/318 X |
| 3,446,438 | 5/1969 | Watson | 239/318 |
| 3,485,454 | 12/1969 | Walker | 239/434 |
| 3,486,695 | 12/1969 | Novak | 239/304 X |
| 3,563,468 | 2/1971 | Holzinger | 239/434 X |
| 3,713,585 | 1/1973 | Conklin | 239/307 |
| 3,720,352 | 3/1973 | Kozlowski | 222/132 |
| 3,759,284 | 9/1973 | Crowley et al. | 137/268 |
| 3,770,209 | 11/1973 | Wilcox | 239/434 |
| 3,917,172 | 11/1975 | O'Hare | 239/305 |
| 4,019,658 | 4/1977 | Consaul | 222/144.5 |
| 4,027,822 | 6/1977 | Usher | 239/305 |
| 4,219,158 | 8/1980 | Lacy | 239/305 |
| 4,293,083 | 10/1981 | Meares, Jr. | 222/133 |
| 4,295,612 | 10/1981 | Betsinger | 239/310 |
| 4,505,431 | 3/1985 | Huffman | 239/434 X |

*Primary Examiner*—Joseph F. Peters, Jr.
*Assistant Examiner*—Kevin Patrick Weldon
*Attorney, Agent, or Firm*—Andrus, Sceales, Starke & Sawall

[57] ABSTRACT

An improved shower head dispenser for selectively dispensing and mixing liquid additives with shower water. The shower head dispenser comprises a body having a water inlet connected to a source of water under pressure and having an outlet. The body also defines an inlet chamber communicating with the inlet and a small diameter passage connects the inlet chamber with the outlet. One or more liquid additives are contained in separate bottles or containers and each container is connected through a supply line to a manually operated valve. The valve selectively connects each supply line with an aspirating conduit which communicates with the passage in the body. The body also includes a series of the larger outer passages which connect the inlet chamber and the outlet and are located around the first passage. The flow of water through the first passage creates an aspirating action to draw the liquid additive from the desired container and mix the additive with the water which is then dispensed through the outlet. The volume of water flow through the outer passages will vary with water pressure variations, while the volume of water flowing through the first passage will remain relatively constant regardless of variations in water pressure to thereby provide a uniform delivery of the liquid additive at all times.

3 Claims, 5 Drawing Figures

SHOWER HEAD WHICH UNIFORMLY DISPENSES LIQUID ADDITIVES

BACKGROUND OF THE INVENTION

Various types of shower head dispensers have been used in the past to selectively dispense and mix liquid additives, such as soap, shampoo, or body oil, with the shower spray. For the most part, the typical shower head dispenser utilizes the aspirating effect of the shower spray to draw the liquid additive into the shower water. The typical shower head dispenser may include containers for several liquid additives and a manually operated valving arrangement is employed to selectively control the delivery of the liquid additives.

In the typical household, the water pressure is apt to fluctuate due to variations in the main pressure or by virtue of drawing water at other locations in the household. With shower head dispensers as used in the past, which operate on an aspirating action, variations in water pressure, or variations in water volume due to operation of the shower valve itself, result in a corresponding variation in the amount of liquid additive being dispensed. The shower head dispensers as used in the past have not been capable of maintaining a substantially uniform delivery of the liquid additive regardless of variations in water pressure.

SUMMARY OF THE INVENTION

The invention is directed to an improved shower head dispenser for selectively dispensing and mixing liquid additives with the shower water, in which the amount of additive will remain substantially constant even though the water pressure may vary considerably.

In accordance with the invention, the shower head dispenser includes a body having a water inlet at one end connected to a suitable source of water under pressure and having an outlet in the opposite end. The central portion of the body defines an inlet chamber and a small diameter passage connects the inlet chamber with the outlet.

One or more liquid additives, such as soap, hair shampoo, body oil, or the like, are contained in bottles or containers mounted adjacent the shower head and each container is connected through a supply line to a manually operated valve mounted on the shower head. The valve, in turn, connects each supply line with an aspirating conduit which communicates with the passage in the body. With this construction, flow of water through the passage creates a pressure differential to selectively draw one of the liquid additives from the respective container to the passage and mix the additive with the shower water, with the mixture then being discharged through the outlet.

The body also includes a second series of outer passages which connect the inlet chamber and the outlet and are located radially outward of the first inner passage. Excess water, over and above that flowing through the inner passage, flows through the outer passages to the outlet. With this arrangement, the flow of water through the inner passage remains substantially constant regardless of variations in water pressure, and as the flow through the inner passage is constant, the amount of the liquid additive being drawn into the inner passage through the aspirating action will also remain substantially constant regardless of variations in water pressure or volume. If the water pressure or volume increases, the excess volume of water will pass through the outer passages to the outlet, while conversely, if the water pressure decreases, the flow through the outer passages will correspondingly decrease.

The shower head dispenser of the invention is a compact unit, no larger in size than a conventional shower head. As a further advantage, the shower head dispenser is of simple construction, requiring only six separate parts.

Through use of the manually operated valve, any number of liquid additives, such as soap, shampoo, body oil and the like, can be selectively blended in the shower water.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
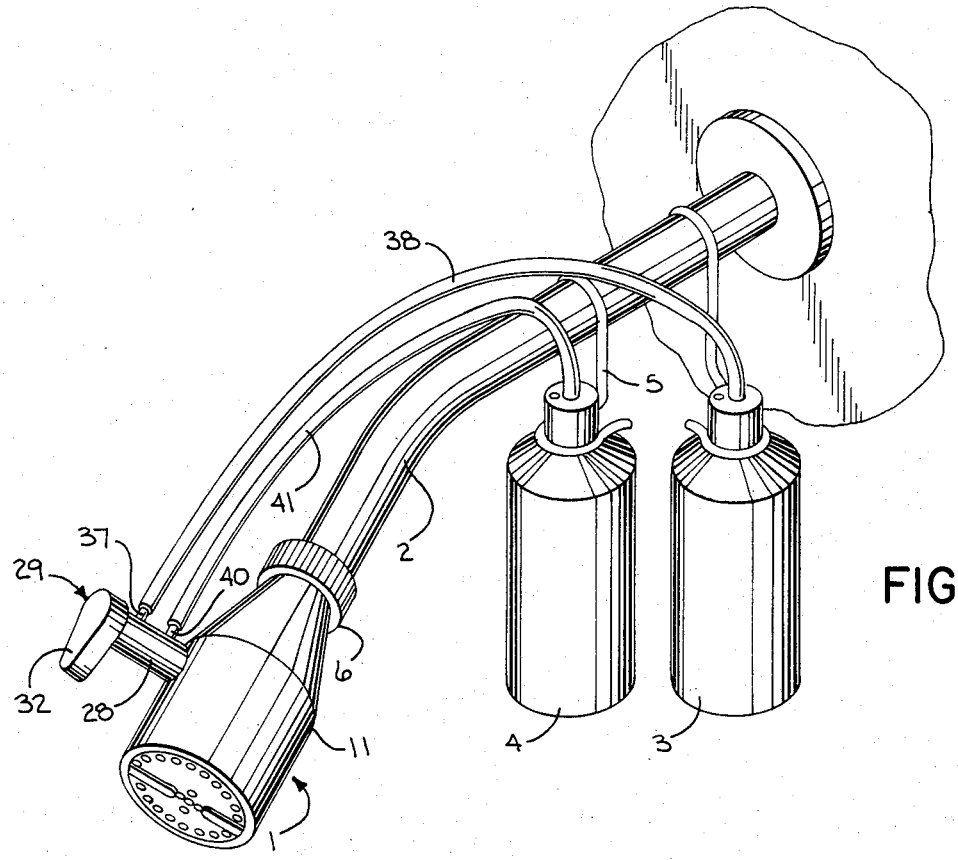
FIG. 1 is a perspective view of the shower head dispenser of the invention as used to dispense two liquid additives.

FIG. 1 illustrates the shower head dispenser 1 of the invention attached to a water pipe 2 and adapted to selectively dispense liquid additives contained within containers 3 and 4 which are mounted through a wire form bracket 5 from pipe 2.

Figure 2:
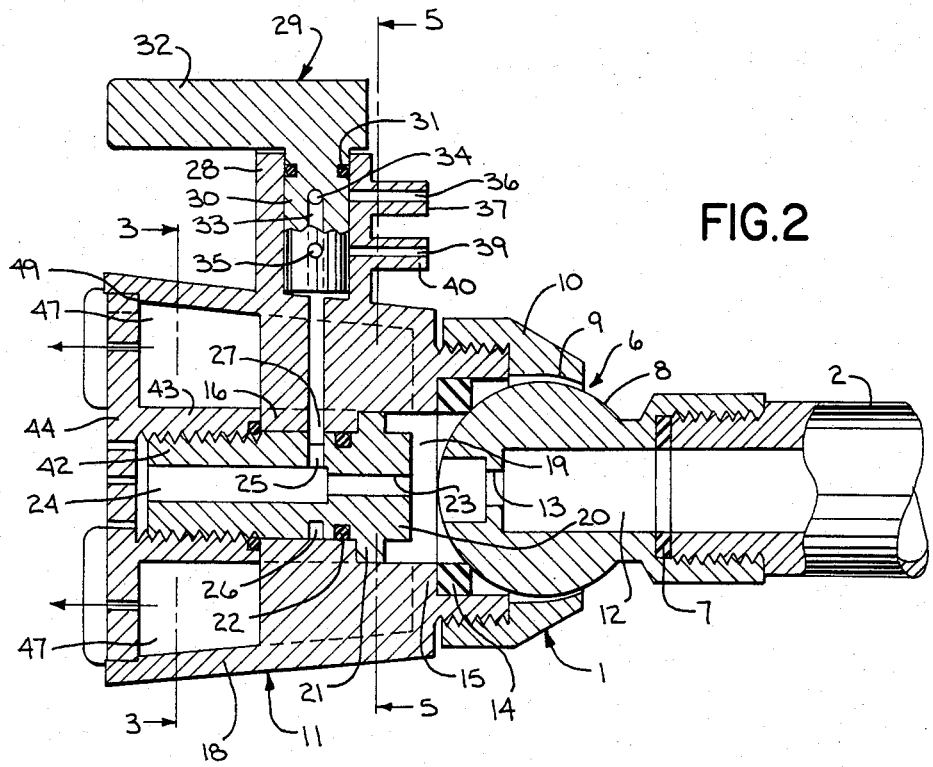
FIG. 2 is a longitudinal section of the dispenser.

The shower head dispenser 1 is best illustrated in FIG. 2 and includes a swivel coupling 6 which is threaded on pipe 2 and the joint between coupling 6 and pipe 2 is sealed by gasket 7.

Swivel coupling 6 also includes a spherical swivel 8 which is mounted within a socket 9 in adapter 10. As best shown in FIG. 2, adapter 10 is threaded onto the inner end of a body 11. Swivel 8 is formed with a central opening 12 which is in communication with the pipe 2, and opening 12 contains a small diameter orifice 13 which reduces the flow through the shower head for energy savings.

To provide a seal between the swivel coupling and the body, an annular gasket 14 is mounted on a shoulder 15 in body 11 and seals against the outer surface of the spherical swivel 8.

Figure 3:
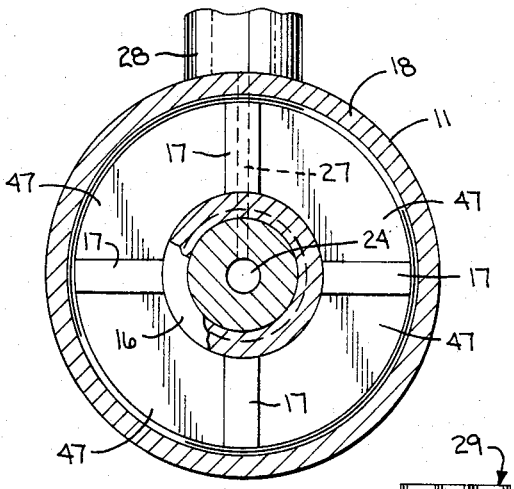
FIG. 3 is a transverse section taken along lines 3—3 of FIG. 2.

Body 11 includes a central ring 16, as shown in FIG. 3, which is connected through a series of radially extending legs 17 to the outer wall 18 of the body.

The inner end portion of body 11 defines an inlet chamber 19 which is in communication with the central opening 12 of spherical coupling 6.

Mounted within ring 16 is a nozzle 20 and nozzle 20 is provided with an outwardly extending flange 21 which bears against the inner end of ring 16. Nozzle 20 is sealed to the ring through an O-ring seal 22, which seats within a circumferential groove in the nozzle 20.

As best shown in FIG. 2, nozzle 20 if formed with an axial passage 23 which is aligned with the central opening 12 in swivel coupling 6, and the outer end of passage 23 communicates with a larger diameter axial passage 24 which extends to the outer end of nozzle 20.

In addition to passages 23 and 24, nozzle 20 is provided with a radial opening 25 which communicates with the inner end of passage 24 and the outer end of opening 25 joins a circumferential groove 26 in the nozzle.

As shown in FIGS. 2 and 3, a radial passage 27 extends trhough ring 16 and through one of the legs 17 and communicates with groove 26. The outer end of passage 27 is connected to the interior of a tube 28 which is formed integrally with body 11 and extends outwardly from the body.

A valve member 29 includes a stem 30 that is mounted for rotation within tube 28 and an O-ring seal 31 seals the joint between the stem 30 and tube 28.

As shown in FIG. 2, the outer end of stem 30 defines a handle 32 through which the stem 30 can be rotated.

The stem 30 of valve member 29 includes an axial passage 33 which is aligned with passage 27 and a pair of transverse passages 34 and 35 are connected to axial passage 33. Passages 34 and 35 are located 180° apart. By rotation of valve member 29, the upper passage 34 can be brought into registry with a passage 36 formed in tubular extension 37 on tube 28. Extension 37 is connected by flexible hose 38 to container 3 which is mounted on pipe 2.

Similarly, rotation of valve member 29 in the opposite direction can bring the second passage 35 into registry with a passage 39 in extension 40 on tube 28 and extension 40 is connected by hose 41 to container 4.

Figure 4:
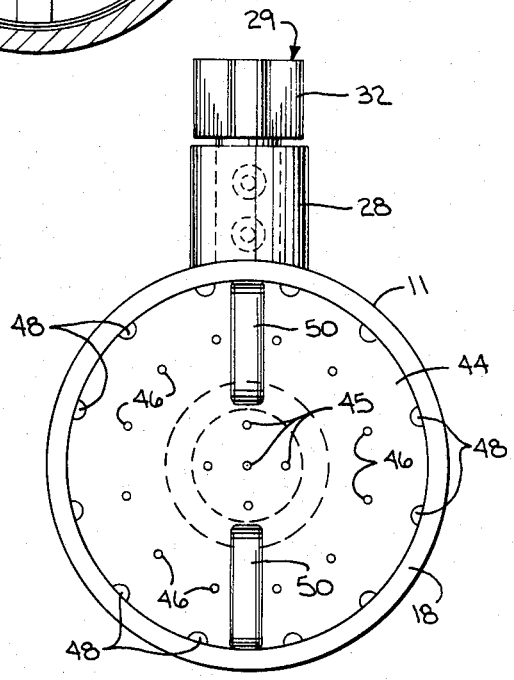
FIG. 4 is an end view of the dispenser.

The outer end 42 of nozzle 20 is provided with an external thread and is connected to a boss 43 on cap 44. As best shown in FIG. 4, cap 44 is provided with a first series of holes 45 which communicate with the central passage 24 of nozzle 20, while a second series of holes 46 communicate with the passages 47 located between legs 17. In addition, the outer periphery of cap 44 is formed with a series of spaced slots 48 which are partially restricted by shoulder 49 formed in the outer end of body 11.

For adjustment purposes the cap 44 has a pair of finger grips 50, and by rotating the cap, slots 48 can be moved toward and away from the shoulder 49 to provide an adjustment of water flow from the shower head.

Figure 5:
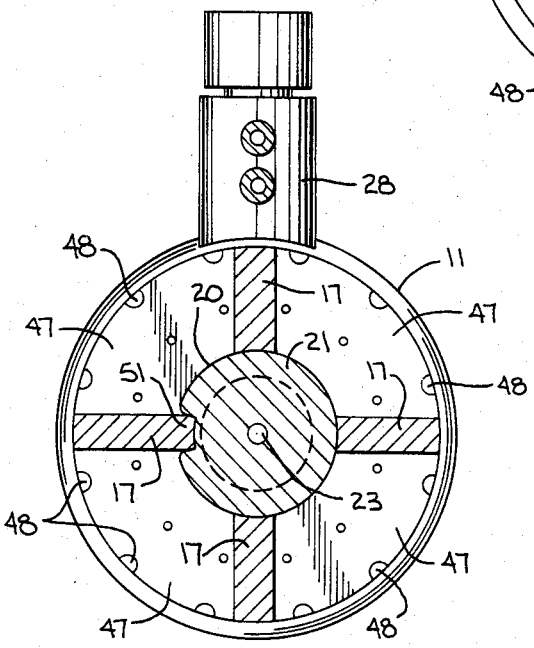
FIG. 5 is a section taken along line 5—5 of FIG. 2.

To provide proper orientation of nozzle 20 within body 11, flange 21 is provided with a notch which is adapted to engage a lug 51 formed on one of the legs 17, as shown in FIG. 5.

As shown in the drawings, the shower head dispenser is adapted to dispense and mix two liquid additives with the shower water. However, it is contemplated that any number of additives can be utilized. With the construction shown in the drawings, valve 29 has three positions. The first positon is an "off" position in which both of the passages 34 and 35 are out of registry with the corresponding passages 36 and 39, so that no liquid additive is dispensed. By rotating the valve member 29 to a second position, the passage 34 will be brought into registry with passage 36, thereby resulting in the dispensing of the liquid additive from container 3. By rotating the valve to a third position, so that passage 35 is in registry with passage 39, the additive from container 4 will be dispensed.

The liquid additives from containers 3 and 4 are dispensed by an aspirating action. As the water flows through the nozzle 20, a pressure differential is achieved which will draw the liquid additive by an aspirating action from the selected container through passage 27 and opening 25 to the axial passage 24 where the additive will be mixed with the shower water. The groove 26 insures that the passage 27 will be in communication with the opening 25 regardless of the orientation of nozzle 20. The mixture of additive and shower water is then discharged from the outer end of the nozzle through holes 45 in cap 44. In addition to the water flowing through the nozzle 20, a substantially greater quantity of water will flow from the inlet chamber 19 through the passages 47 and be discharged through holes 46 and slots 48 in cap 44.

As the cross sectional area of passage 23 is substantially less than the total cross sectional area of passages 47, only a small portion of the water flow will pass through the passage 23. Therefore, if the water pressure or volume changes, the variation in water volume will be accommodated by flow through passages 47 and the flow through passage 23 will remain substantially constant. As the flow through passage 23 will be constant regardless of variations in water pressure, the amount of liquid additive being dispensed will also remain substantially constant.

The shower head dispenser is a compact unit and is no larger in size than a conventional shower head. As a further advantage, the shower head dispenser of the invention is of simple and inexpensive construction. It is preferred that the components of the dispenser be composed of plastic materials and the dispenser requires only six separate parts.

Various modes of carrying out the invention are contemplated as being within the scope of the following claims particularly pointing out and distinctly claiming the subject matter which is regarded as the invention.

I claim:

1. A shower head dispenser, comprising a body having a water inlet in one end connected to a source of water under pressure and having an outlet in the opposite end, said body including a central annular section and an outer wall spaced radially outward of said annular section, said body also including at least one radially extending leg connecting said annular section with said outer wall, said annular section defining a longitudinally extending first passage communicating between said inlet and said outlet and the space between said annular section and said outer wall defining a second passage communicating between said inlet and said outlet, said leg having a third radial passage communicating between said first passage and the exterior of said body, a plurality of containers, each containing a liquid additive, a supply line connected to each container, aspirating conduit means interconnecting said third passage and each supply line, and manually operated valve means interconnecting said supply lines and said aspirating conduit means whereby the additives can be selectively dispensed, flow of water through said first passage creating an aspirating action to draw liquid additive from one of said containers through said third passage to said first passage and mixing said additive with the water.

2. The dispenser of claim 1, and including a cap disposed in said outlet and having a plurality of discharge holes, one group of said holes communicating with said first passage and a second group of said holes communicating with said second passage.

3. The dispenser of claim 1, and including a swivel coupling connecting said body to said source of water.

* * * * *